United States Patent [19]

Endo

[11] 4,208,542

[45] Jun. 17, 1980

[54] CABLE FOR PARTICULAR USE WITH LOUDSPEAKERS

[75] Inventor: Shin Endo, Tokyo, Japan

[73] Assignee: Toko Tokushu Densen Kabushiki Kaisha, Tokyo, Japan

[21] Appl. No.: 885,799

[22] Filed: Mar. 13, 1978

Related U.S. Application Data

[63] Continuation-in-part of Ser. No. 756,985, Jan. 5, 1977, abandoned.

[30] Foreign Application Priority Data

Aug. 26, 1976 [JP] Japan ..... 51-101096

[51] Int. Cl.[2] ..... H01B 7/00

[52] U.S. Cl. ..... 174/113 C; 174/114 S

[58] Field of Search ..... 174/113 R, 113 C, 114 R, 174/114 S, 117 M

[56] References Cited

U.S. PATENT DOCUMENTS

| | | | |
|---|---|---|---|
| 3,823,253 | 7/1974 | Walters | 174/113 C |
| 3,909,508 | 9/1975 | Ross | 174/117 M |

FOREIGN PATENT DOCUMENTS

| | | | |
|---|---|---|---|
| 448670 | 5/1948 | Canada | 174/113 C |

*Primary Examiner*—E. A. Goldberg

*Attorney, Agent, or Firm*—Marshall & Yeasting

[57] ABSTRACT

A cable in the form of a tubular braid which is built of two oppositely directed, helically interlaced sets of strands of untwisted, individually insulated, fine copper wires. Each wire strand of each set repeatedly passes over two consecutive strands, and then under the next two consecutive strands, of the other set. At each extremity of the braid, the end portions of all the stranded wires are stripped of their insulations, assembled into two predetermined groups, and preferably soldered, to provide a pair of terminals.

9 Claims, 8 Drawing Figures

CABLE FOR PARTICULAR USE WITH LOUDSPEAKERS

CROSS-REFERENCE TO RELATED APPLICATION

This is a continuation-in-part application of my earlier application Ser. No. 756,985, filed on Jan. 5, 1977, now abandoned.

BACKGROUND OF THE INVENTION

1. Field of the Invention

My invention relates to electric conductors and is directed more specifically to the novel construction of a cable or cord best suited for use as connections between loudspeakers and an amplifier or the like in a high-fidelity sound-reproducing system of the module type.

2. Description of the Prior Art

It is now almost an established fact among audio specialists and enthusiasts that cables connecting an amplifier and loudspeakers in a module-type sound-reproducing system can appreciably affect the quality of sound reproduced, particularly when the cables are as long as five meters or more. Vinyl-insulated twin cables that have been used extensively for this purpose have been found inferior to, for instance, star quad cables for high fidelity sound reproduction, especially in the high frequency range. This is due principally to the higher inductance of the twin cable. At higher frequencies, the electromotive force due to the self-inductance of the twin cable (counterelectromotive force) increases to make an electric current harder to flow therethrough.

In order to derive the utmost sound quality from loudspeakers of usual 8-ohm impedance, amplifier output signals should be delivered thereto via cables having characteristic impedance of approximately 8 ohms and a minimum of DC resistance, among other properties. The characteristic impedance of conventional cables used for the purpose in question is totally mismatched with the loudspeaker impedance, being usually as high as from 100 to 200 ohms. The use of such conventional cables results in considerable deterioration of the sound quality over the entire audio frequency range.

SUMMARY OF THE INVENTION

It is an object of my invention to provide a cable of novel construction particularly well adapted for connecting loudspeakers and an amplifier or the like in a module-type high-fidelity sound-reproducing system, such that the quality of sound reproduced can be markedly improved.

Another object of my invention is to provide a cable of the character described which lends itself to easy and highly economical mass-production.

These and other objects are accomplished, in accordance with my invention, by the provision of a cable comprising a tubular braid having two opposed, helically running sets of strands of individually insulated wires. The two sets of wire strands are interlaced in such a way that each strand of each set repeatedly passes over two consecutive strands, and then under the next two consecutive strands, of the other set. At each extremity of the tubular braid, a pair of terminals are formed by closely assemblying the end portions of the wire strands into two predetermined groups.

In one embodiment of my invention, positive and negative strands of wires are arranged alternately in each of the two helically opposed sets of such wire strands, and these positive and negative wire strands are separately grouped at each extremity of the tubular braid to form the pair of terminals. In another embodiment, one of the two sets is composed of positive strands of wires only, and the other set is composed of negative strands of wires only. The positive and the negative sets of wire strands are of course separately grouped at each extremity of the tubular braid to form the pair of terminals.

The characteristic impedance of the cable of the foregoing construction can be made very close to the usual loudspeaker impedance of 8 ohms, and its DC resistance is also minimized. The use of this cable has proved to result in substantial improvement in the quality of sound reproduced, and this improved sound quality is little affected by the length of the cable in use. As an additional advantage, the cable can be mass-produced by a conventional braiding machine.

The above and other objects, features and advantages of my invention and the manner of attaining them will become more readily apparent, and the invention itself will best be understood, upon consideration of the following description, with reference had to the accompanying drawings showing preferred embodiments of the invention.

DESCRIPTION OF THE PREFERRED EMBODIMENTS

Figure 1:
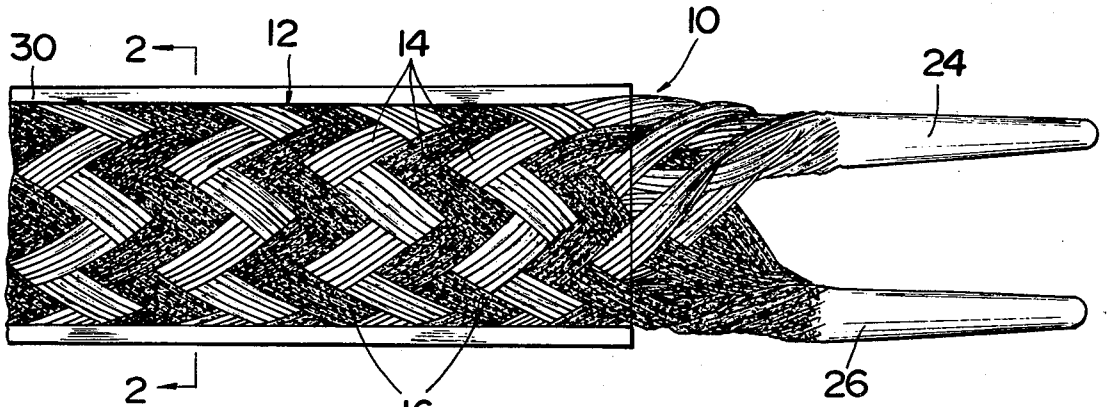
FIG. 1 is a partial elevational view of a preferred form of the cable according to my invention.
Figure 2:
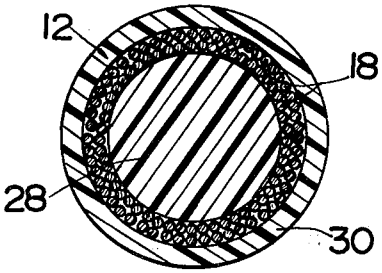
FIG. 2 is a sectional view taken along the line 2—2 of FIG. 1.

A first preferred form of the cable according to my invention is illustrated in FIGS. 1 and 2 of the drawings and is therein generally designated 10. The cable 10 comprises a braid 12 of tubular form built of a plurality of strands or groups of individually insulated, relatively fine, high-purity copper wires, which wire strands are interlaced in two oppositely directed, helically running sets. The two complete sets of wire strands are respectively designated 14 and 16 in FIG. 1, and the individual wires of which the strands are formed are designated 18 in FIGS. 2 through 4.

Figure 3:
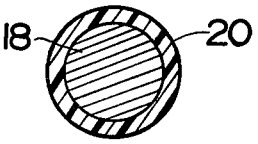
FIg. 3 is an enlarged cross-sectional view of one of the insulated wires used in the cable of FIG. 1.
Figure 4:
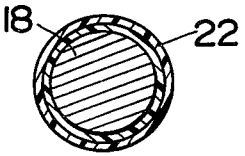
FIG. 4 is a view similar to FIG. 3 but showing an alternative form of insulated wire which can be used in the cable according to my invention.

As illustrated cross-sectionally and on a greatly enlarged scale in FIG. 3, each wire 18 has formed thereon a thin, electrically insulating covering 20 of, for example, polyurethane resin. Alternatively, as shown in FIG. 4, each wire may have a thin, insulating covering 22 of dual layer construction comprising layers of, for example, polyamide and polyurethane resins.

With reference back to FIGS. 1 and 2, a preselected number of such insulated wires are laid parallel to each other to form a single strand, and a preselected number of such wire strands are woven into the tubular braid 12 in the two opposed, helical sets 14 and 16 by means of a braiding machine. A close consideration of FIG. 1 will show that the two sets 14 and 16 of wire strands are interlaced in such a manner that each strand of each set repeatedly passes over two consecutive strands, and then under the next two consecutive strands, of the other set.

A further feature of the cable 10 of FIG. 1 resides in the fact that each of the sets 14 and 16 has alternating positive and negative strands of wires. At each extremity of the tubular braid 12, all the positive and all the negative strands of wires are separately grouped to provide a pair of terminals 24 and 26. In order to form these cable terminals 24 and 26, the end portions of all the positive and the negative wires are stripped of their insulations 20 or 22, separately twisted together, and preferably soldered for the sake of utmost performance and convenience in use. The conventional dip soldering method may be employed for thus soldering the cable terminals.

Preferably, the positive and the negative strands of wires of the cable 10 should be colored in contrastive of different colors so that they may be correctly separately grouped together at each extremity of a desired cable length, and also that the completed cable may be electrically correctly connected between a loudspeaker system and an amplifier or the like. This purpose can be accomplished by dying the insulating coverings 20 or 22 of the positive and/or negative strands of wires in a suitable color or colors.

Seen at 28 in FIG. 2 is a rod-shaped core of electrically insulating, suitably flexible material such as plastics, preferably polyvinyl chloride (PVC), that is fitted within the tubular braid 12 of the cable 10. This core 28 is intended to maintain the cable brain 12 in the desired tubular shape in use. The cable braid 12 is further shown to be enveloped in a protecting covering 30 of electrically insulating, suitably flexible material such as PVC. Preferably, the outer covering 30 is fabricated from transparent material, from an aesthetic point of view, in case the positive and the negative strands of wires are colored differently as above. The provision of the core 28 and the covering 30, however, is not of absolute necessity.

In view of the desired electrical properties of the cable 10 and the limitations in rigidity imposed by mechanical braiding, each wire 18 used for the manufacture of the cable is preferably in the range of from about 0.16 to about 0.18 millimeter in diameter. It has also been discovered by experiment that for the best results, from about three to about six such wires should be grouped into a single strand, and that from about 16 to about 24 such strands should be braided into a single cable, provided that the total number of wires in the cable is not less than about 60. The cable 10 of FIG. 1 is shown to comprise 12 positive and 12 negative strands each comprising five individually insulated wires.

Figure 5:
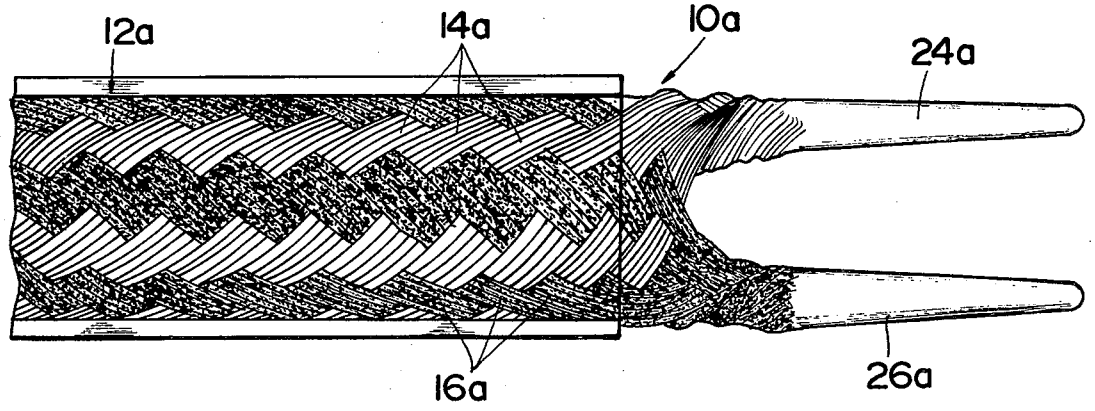
FIG. 5 is a view similar to FIG. 1 but showing another preferred embodiment of my invention.

FIG. 5 illustrates another preferred form of the cable according to my invention, generally designated 10*a*, that differs from the cable 10 of FIG. 1 in the relative arrangement of the positive and the negative strands of wires. In this cable 10*a* the two opposed, helically running sets 14*a* and 16*a* of wire strands forming the tubular braid 12*a* are separately grouped at each cable extremity to provide a pair of terminals 24*a* and 26*a*. In other words, the braid 12*a* is built of the positive and the negative sets 14*a* and 16*a* of wire strands interlaced in opposed helices. Except for this "polarity arrangement", the cable 10*a* is exactly identical in construction with the cable 10 described above in connection with FIGS. 1 through 4.

In order to ascertain the pertinent electrical characteristics of the above described cables 10 and 10*a*, four specimens of each cable, made of different numbers of wires, were prepared. All these specimens were each built of 24 strands (12 in each set) of insulated wires each with a diameter of 0.18 millimeter. Ten meters of each specimen was measured as to its DC resistance R, capacitance C, inductance L, and impedance Zo. The results are tabulated below:

| Specimen | No. of wires in each strand | R (Ω) | C (pf) | L (μH) | Zo (Ω) |
|---|---|---|---|---|---|
| Cable 10 | | | | | |
| I | 6 | 0.10 | 30,400 | 1.55 | 7.1 |
| II | 5 | 0.12 | 14,900 | 1.55 | 10.2 |
| III | 4 | 0.15 | 13,000 | 1.50 | 10.7 |
| IV | 3 | 0.22 | 7,400 | 1.52 | 14.3 |
| Cable 10a | | | | | |
| V | 6 | 0.10 | 34,000 | 1.47 | 6.6 |
| VI | 5 | 0.12 | 27,000 | 1.45 | 7.3 |
| VII | 4 | 0.15 | 22,500 | 1.51 | 8.2 |
| VIII | 3 | 0.22 | 14,500 | 1.42 | 9.9 |

It will be noted from the above table that the impedance (defined as $Zo \div \sqrt{L/C}$) values of all the cable specimens are sufficiently close to the usual loudspeaker impedance of 8 ohms. Audio signals can therefore be faithfully transmitted from amplifier to loudspeakers through such cables. Of all the cable specimens tested, that which is currently believed to be the most desirable is Specimen II, with its capacitance of 14,900 picofarads and its comparatively low DC resistance and impedance values. Specimen II, of course, is constructed in accordance with the "polarity arrangement" of FIG. 1, with each of its strands composed of five wires as in the drawing.

Figure 6A:
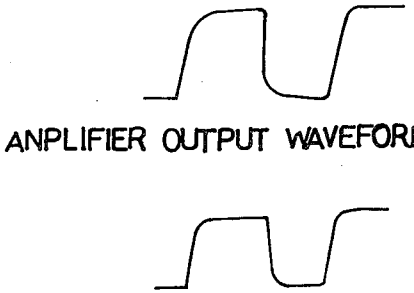
FIG. 6A is a waveform diagram explanatory of the pulse transmission characteristic of the cable according to my invention.
Figure 6B:
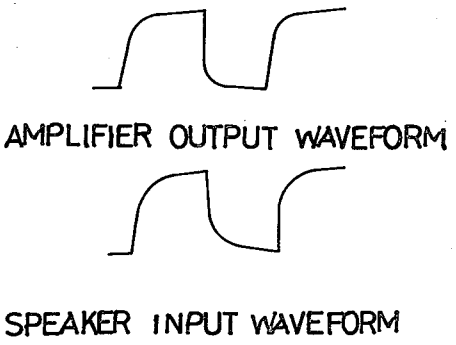
FIG. 6B is a waveform diagram corresponding to FIG. 6A and explanatory of the pulse transmission characteristic of the prior art twin cable by way of comparison.

The pulse transmission characteristic of the cable according to my invention, in comparison with that of the prior art vinyl-insulated twin cable, will become apparent upon consideration of FIGS. 6A and 6B. The pulse transmission characteristic was determined by connecting 10 meters of each of Specimen II of the cable according to the invention and the prior art twin cable between power amplifier (Luxman MQ-60) and loudspeaker system (Victor SX-7) and by supplying a 100-kilohertz rectangular pulse train through the amplifier. The twin cable was of the type wherein each strand was composed of 30 wires each with a diameter of 0.18 millimeter.

FIG. 6A is an oscillographic representation of amplifier output waveform (top) and loudspeaker input waveform (bottom) in case Specimen II of the cable according to my invention is connected as above, and FIG. 6B a similar representation of waveforms in case the prior art twin cable is connected. It will be seen from these representations that each loudspeaker input pulse, particularly its rise, is appreciably more faithful in shape to the amplifier output pulse when the cable of my invention is connected between amplifier and loudspeaker than when the prior art twin cable is connected.

Figure 7:
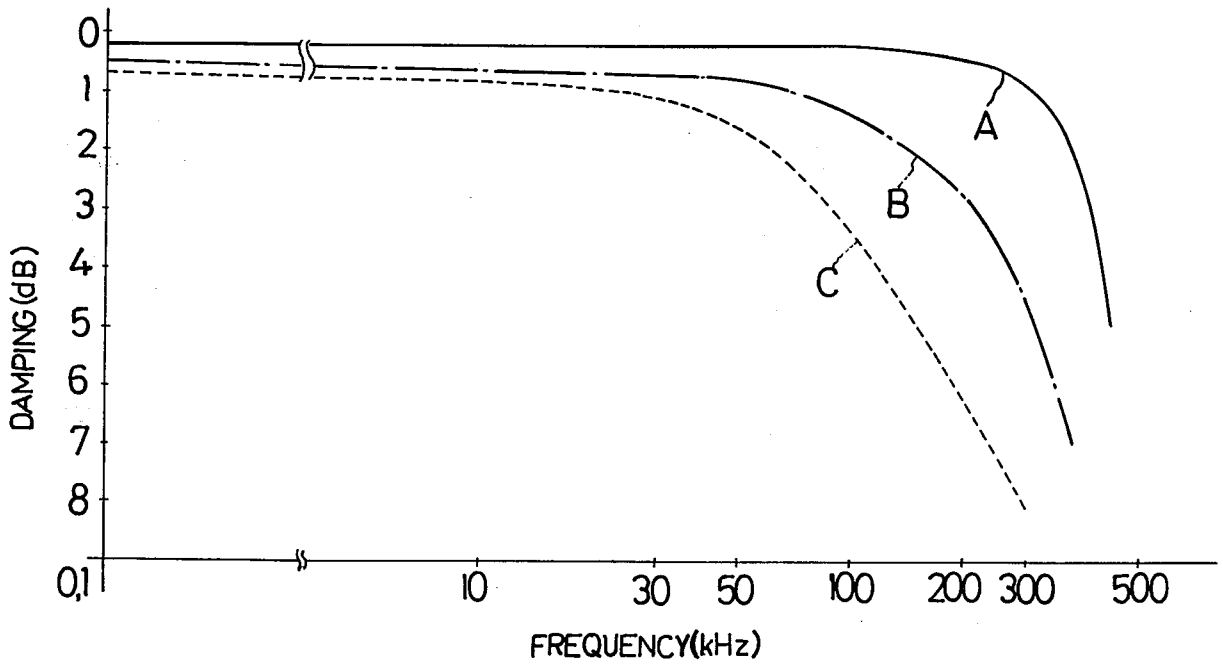
FIG. 7 is a graphic representation of the frequency characteristic of the cable according to my invention, as well as those of some prior art cables given by way of comparison.

Graphically represented in FIG. 7 is the frequency characteristic of the cable according to my invention, as well as those of some prior art cables by way of reference. The graph plots the curves of signal damping by the cables, in decibels, against various frequencies in kilohertz. The curve A represents the frequency characteristic of Specimen II of the cable according to the invention, the curve B that of the prior art coaxial cable (RG58U), and the curve C that of the prior art twin cable of the type specified previously. The frequency characteristics were determined by connecting 10 meters of each of the listed cables between power amplifier and 8-ohm impedance and by supplying a signal of varying frequencies through the amplifier.

it will be evident from the graph of FIG. 7 that improved sound reproduction is possible with the cable according to my invention, particularly in the high frequency range. While the damping of energy in the high frequency range is due principally to the self-inductance of the cables, as mentioned, that in the low frequency range is due to their DC resistance. The graph shows that the DC resistance of the cable according to the invention is also sufficiently low. This cable is therefore quite suitable for use as connections between loudspeakers and amplifier or the like in a high-fidelity sound-reproducing system.

It will be understood that various modifications may be made to the specific forms of the cable which have been disclosed, merely by way of non-limiting example, without departing from the spirit or scope of my invention as sought to be defined by the following claims.

I claim:

1. A cable for particular use in connecting a loudspeaker system and an amplifier or the like in a module-type high-fidelity sound-reproducing system, comprising a tubular braid having two opposed, helically running sets of strands of individually insulated wires, the two sets of strands of wires being interlaced in such a way that each strand of each set repeatedly passes over two consecutive strands and then under the next two consecutive strands of the other set, and a pair of terminals formed at each extremity of the tubular braid by closely assemblying the end portions of the strands of wires into two predetermined groups.

2. A cable as defined in claim 1, further comprising a core of electrically insulating, relatively flexible material fitted within the tubular braid.

3. A cable as defined in claim 1, further comprising a protecting cover of electrically insulating, relatively flexible material fitted over the tubular braid.

4. A cable for particular use in connecting a loudspeaker system and an amplifier or the like in a module-type high-fidelity sound-reproducing system, comprising a tubular braid having two opposed, helically running sets of positive and negative strands of wires, each wire having an insulating covering thereon, the two sets of positive and negative strands of wires being interlaced in such a way that each strand of each set repeatedly passes over two consecutive strands and then under the next two consecutive strands of the other set, the positive and the negative strands of wires of each set being arranged alternately, and a pair of terminals formed at each extremity of the tubular braid by separately grouping the end portions of the positive and the negative strands of wires.

5. A cable as defined in claim 4, wherein the wires are each in the range of from about 0.16 to about 0.18 millimeter in diameter.

6. A cable as defined in claim 5, wherein each of the positive and the negative strands comprises from about three to about six such wires, and wherein the total number of the positive and the negative strands ranges from about 16 to about 24.

7. A cable for particular use in connecting a loudspeaker system and an amplifier or the like in a module-type high-fidelity sound-reproducing system, comprising a tubular braid built of a positive and a negative set of strands of individually insulated wires, the positive and the negative set of strands of wires being interlaced in opposed helices and in such a way that each strand of each set repeatedly passes over two consecutive strands and then under the next two consecutive strands of the other set, and a pair of terminals formed at each extremity of the tubular braid by separately grouping the end portions of the positive and the negative set of strands of wires.

8. A cable as defined in claim 7, wherein the wires are each in the range of from about 0.16 to about 0.18 millimeter in diameter.

9. A cable as defined in claim 8, wherein each of the strands comprises from about three to about six such wires, and wherein the total number of the strands in the tubular braids ranges from about 16 to about 24.

* * * * *